United States Patent [19]

Martin

[11] 4,440,231

[45] Apr. 3, 1984

[54] DOWNHOLE PUMP WITH SAFETY VALVE

[75] Inventor: Albert E. Martin, Ratliff City, Okla.

[73] Assignee: Conoco Inc., Ponca City, Okla.

[21] Appl. No.: 270,332

[22] Filed: Jun. 4, 1981

[51] Int. Cl.[3] ..... E21B 34/16

[52] U.S. Cl. ..... 166/373; 166/382; 166/68; 166/106; 166/332; 417/448

[58] Field of Search ..... 166/106, 373, 382, 334, 166/105, 68, 80, 54.1, 53, 115, 114, 150; 417/448, 449, 450

[56] References Cited

U.S. PATENT DOCUMENTS

| | | | |
|---|---|---|---|
| 200,357 | 2/1878 | Swett | 103/39 |
| 564,674 | 7/1896 | Wilson | 417/259 |
| 1,353,391 | 9/1920 | Hall | 417/448 |
| 1,754,946 | 4/1930 | Haskell | 103/5 |
| 2,133,655 | 10/1938 | Brotzman et al. | 417/448 |
| 2,215,164 | 9/1940 | Shupe | 103/181 |
| 2,327,503 | 8/1943 | Coberly | 166/143 |
| 2,429,848 | 3/1945 | Smith | 166/106 |
| 3,419,076 | 12/1968 | Sizer et al. | 166/53 |
| 3,473,606 | 10/1969 | Page, Jr. | 166/53 |
| 4,161,215 | 7/1979 | Bourne, Jr. et al. | 166/53 |
| 4,211,279 | 7/1980 | Isaacks | 166/64 |

*Primary Examiner*—James A. Leppink
*Assistant Examiner*—Hoang C. Dang
*Attorney, Agent, or Firm*—A. Joe Reinert

[57] ABSTRACT

Apparatus and methods are provided for installing and removing a downhole rod pump form a well while preventing flow of fluids from the well through a production tubing string.

9 Claims, 2 Drawing Figures

DOWNHOLE PUMP WITH SAFETY VALVE

BACKGROUND OF THE INVENTION

The present invention relates generally to a downhole rod pump assembly, and more particularly, but not by way of limitation, to such an assembly adapted for safe use in steamflood operations.

A typical downhole rod pump is seated in a seating nipple within a production tubing string, and the lower end of the production tubing string is always open to the well bore so that fluid from the well is drawn into the pump and then pumped from the pump upward through the production tubing string upon reciprocable motion of a string of sucker rods connected between the rod pump and a walking beam pump jack located at the ground surface.

A safety problem is encountered with typical prior art rod pump apparatus when such apparatus are used in a well producing high temperature fluids. For example, in some steamflood operations, the fluid from the well is at a temperature in a range from 90° F. to 310° F. when it reaches the ground surface.

If the rod pump fails, it is sometimes very difficult or impossible to pull the sucker rods and the rod pump out of the well because of the hot fluid flow, or the pulling unit crew may be subject to severe burns from the hot fluid if they do attempt to pull the sucker rods and the rod pump from the well.

Very often, such a well cannot be killed with high density drilling mud in order to allow the rods and pump to be pulled.

The present invention overcomes these problems by providing a production tubing extension extending below the seating nipple and having a spring loaded flapper valve on the lower end of the production tubing extension. The rod pump is provided with a dip tube having a sufficient length such that when the rod pump is seated in the seating nipple, the dip tube engages the flapper valve and holds the flapper valve open. A polished rod at the upper end of the sucker rod string is provided with an extended length so that the rod pump may be positioned at a sufficient distance above the seating nipple so that the dip tube is above the flapper valve allowing the flapper valve to close, while the polished rod is still sealed within a stuffing box connected to an upper end of the production tubing string.

It is, therefore, a general object of the present invention to provide an improved downhole rod pump assembly.

Another object of the present invention is the provision of a downhole rod pump assembly including a spring loaded flapper valve attached to a lower end of an extension of the production tubing.

Yet another object of the present invention is the provision of a downhole pump assembly having a flapper valve on the production tubing, a dip tube connected to a lower end of the rod pump for opening the flapper valve, and an extended length polished rod for allowing the polished rod to be sealed within a stuffing box when the dip tube is at a position above the flapper valve.

Still another object of the present invention is the provision of improved methods of installing and removing a rod pump from a well.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
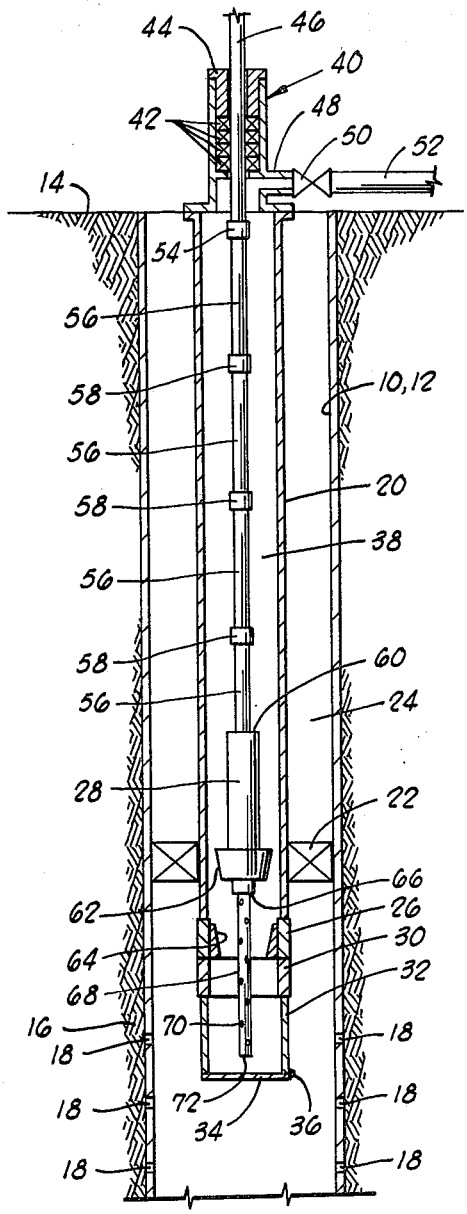
FIG. 1 is a schematic elevation section view of a rod pump being lowered into or removed from a well. The rod pump is in a position above the seating nipple with the lower end of the dip tube above the flapper valve. The polished rod is sealed within the stuffing box.

Referring now to the drawings, a well 10 defined by an inner bore of well casing 12 extends from a ground surface 14 downward and intersets a subterranean formation 16. A plurality of perforations 18 communicate the subterranean formation 16 with the interior of well 10.

A production tubing string 20 is suspended in the well 10 and a packer means 22 seals an annulus 24 between the production tubing string 20 and the well 10.

Connected to a lower end of production tubing string 20 is a seating nipple 26 which may generally be described as a seating means for seating a downhole rod pump 28.

A tubing collar 30 connected a production tubing extension 32 to the seating nipple 26. Connected to a lower end of production tubing extension 32 is a disc-shaped flapper valve 34 which is connected to production tubing extension 32 by a resilient spring means 36. A metal-to-metal seal is provided between flapper valve 34 and the lower end of production tubing extension 32.

Flapper valve 34 provides a valve means for selectively opening and closing the production tubing extension 32 to thereby communicate an interior 38 of production tubing string 20 with and to isolate said interior 28 of production tubing string 20 from the well 10.

Connected to a upper end of production tubing string 20 is a stuffing box 40.

Disposed in stuffing box 40 are a plurality of annular packing members 42 and a packing gland 44 for compressing the packing elements 42 to seal the packing elements 42 around a polished rod 46. Below the packing elements 42 an outlet 48 of stuffing box 40 is attached to a control valve 50, the other end of which is connected to a production line 52.

Connected to a lower end of polished rod 46 at a coupling 54 is a string of sucker rods 56 all of which are connected by couplings 58. A lower end of the string of sucker rods is connected to the upper end 60 of rod pump 28 for actuating the rod pump 28 by reciprocating motion of a plunger therein as is well known to those skilled in the art.

The rod pump means 28 is adapted at 62 to be seated in a seat 64 of seating nipple 26, also in a manner well known to those skilled in the art.

Extending downward from a lower end 66 of rod pump 28 is a dip tube 68 which is a tubular member having a plurality of perforations 70 therein and an open lower end 72.

The dip tube 68 may generally be referred to as a valve actuating means 68 operably associated with the rod pump 28 for opening the flapper valve means 34 when the rod pump 28 is seated in the seating means 64 of seating nipple 26 and for closing the flapper valve 34 when the rod pump 28 is unseated from the seating means 64.

For example, in FIG. 1, the rod pump is illustrated in an unseated position wherein the lower end 72 of dip tube 68 is held above flapper valve 34 so that flapper valve 34 is in a closed position.

The polished rod 46 has a length sufficient such that a lower portion of the polished rod may be sealingly received within the stuffing box 40 as shown in FIG. 1 when the rod pump 28 is in an unseated position and the valve means 34 is in a closed position, also as shown in FIG. 1.

Figure 2:
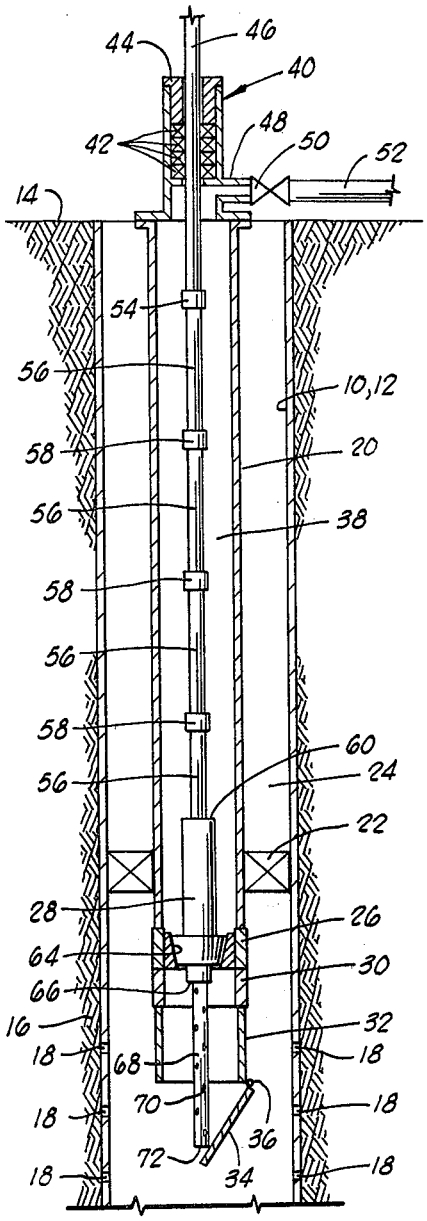
FIG. 2 is a view similar to FIG. 1 showing the rod pump lowered into seating engagement with the seating nipple and showing the dip tube having engaged and opened the flapper valve on the lower end of the production tubing extension.

The dip tube 68 may also be described as a rigid member extending downward from the lower end 66 of rod pump 28 and having a length such that when the rod pump 28 is seated in the seating means 64, as shown in FIG. 2, the rigid member 68 extends below the lower end of tubing extension means 32 as shown in FIG. 2, thereby holding the flapper valve 34 open.

As can be seen in FIG. 1, a combined length of the string of sucker rods 56 below coupling 54, the rod pump 28, and the dip tube 68 is less than a distance between a lowermost one of seals 42 of stuffing box 40 and the lower end of production tubing extension 32. This allows the lower portion of the polished rod 46 to be sealed within stuffing box 40 while the rod pump 28 is in a position above seating nipple 26 such that the lower end 72 of dip tube 68 is above flapper valve 34 allowing flapper valve 34 to be in a closed position as shown in FIG. 1.

The methods of installing and removing the rod pump 28 into and from the well 10 are as follows.

The production tubing string 20 with seating nipple 26 and a production tubing extension 32 must be provided, with a flapper valve 34 on a lower end of the production tubing extension 32.

The rod pump 28 is then attached to a lower end of the string of sucker rods 56. It will be understood that the sucker rods 56 are assembled as the pump 28 is lowered into the well. At the upper end of the string of sucker rods 56, a polished rod 46 is attached. Before lowering the rod pump 28 into the well, the dip tube 68 is attached to the lower end of the rod pump.

Then the sucker rod string, rod pump 28 and dip tube 68 are lowered into the production tubing string 20 to a first position as illustrated in FIG. 1 wherein the lower end 72 of dip tube 68 is above flapper valve 34.

Next, the packing elements 42 are sealed around polished rod 46 by tightening the packing gland 44. Then the polished rod 46 is driven further downward through the stuffing box 40 thereby pushing the flapper valve 34 open with the dip tube 68 and seating the rod pump 28 in the seating nipple 26 as shown in FIG. 2.

To subsequently remove the rod pump 28 from the well 10, the string of sucker rods 56 is raised a first distance to an orientation again such as that shown in FIG. 1, thereby unseating the rod pump 28 from the seating nipple 26 and then moving the dip tube 68 above flapper valve 34 allowing the flapper valve 34 to close. This is done while the polished rod 46 is still sealed within the stuffing box 40.

Once the flapper valve 34 is closed as shown in FIG. 1, it is then safe to break the seal of stuffing box 40 by loosening the packing gland 44 and removing it and the stuffing elements 42 so that the string of sucker rods 56 and the rod pump 28 may then be pulled out of the well 10.

Thus, it is seen that the apparatus and methods of the present invention readily achieve the ends and advantages mentioned as well as those inherent therein. While certain preferred embodiments of the invention have been illustrated for the purposes of the present disclosure, numerous changes in the arrangement and construction of parts and steps may be made by those skilled in the art, which changes are encompassed within the scope and spirit of the present invention as defined by the appended claims.

What is claimed is:

1. A downhole pump assembly, comprising:

a tubing string;

a seating means, connected to a lower end of said tubing string, for seating a downhole pump;

tubing extension means connected to said seating means and extending downward therefrom;

valve means connected to said tubing extension means for selectively opening and closing said tubing extension means to thereby communicate an interior of said tubing string with and isolate said interior of said tubing string from a well bore;

a pump adapted to seat in said seating means; and valve actuating means, associated with said pump, for opening and holding open said valve means when said pump is seated in said seating means and for closing said valve means when said pump is unseated from said seating means.

2. The apparatus of claim 1, wherein the pump is a rod pump and further comprising:

a reciprocable rod string having a lower end attached to said rod pump for actuating said rod pump, said reciprocable rod string having a polished rod at an upper end thereof;

a stuffing box connected to an upper end of said tubing string, and sealingly receiving said polished rod therethrough; and wherein said polished rod has a length sufficient that a lower portion of said polished rod may be sealingly received in said stuffing box when said rod pump is in an unseated position and said valve means is in a closed position.

3. The apparatus of claim 2, wherein:

said valve means is a flapper valve connected to a lower end of said tubing extension means; and said valve actuating means is a dip tube extending downward from a lower end of said rod pump.

4. The apparatus of claim 1, wherein:

said pump is a rod pump;

said valve means is a flapper valve connected to a lower end of said tubing extension means; and said actuating means is a rigid member extending downward from a lower end of said rod pump and having a length such that when said rod pump is seated in said seating means said rigid member extends below said lower end of said tubing extension means thereby holding said flapper valve open.

5. The apparatus of claim 4, wherein:

said rigid member is a perforated dip tube.

6. The apparatus of claim 4, further comprising:

a stuffing box connected to an upper end of said tubing string;

a polished rod reciprocably and sealingly disposed through said stuffing box; and a reciprocable rod string having an upper end attached to a lower end of said polished rod and having a lower end attached to said rod pump for actuating said rod pump.

7. The apparatus of claim 6, wherein:

a combined length of said rod string, said rod pump, and said rigid member is less than a distance between a lowermost seal of said stuffing box and said lower end of said tubing extension.

8. A method of installing a rod pump in a well, said method comprising the steps of:

providing a flapper valve means on a lower end of a tubing extension below a seating means connected to a production tubing string suspended in said well;

attaching said rod pump to a lower end of a sucker rod string, said sucker rod string having a polished rod at an upper end thereof;

attaching a dip tube to a lower end of said rod pump;

lowering said sucker rod string, rod pump, and dip tube into said production tubing to a first position wherein a lower end of said dip tube is above said flapper valve;

sealing said polished rod within a stuffing box attached to an upper end of said production tubing; and then further lowering said sucker rod string and thereby pushing said flapper valve open with said dip tube and then seating said rod pump in said seating means.

9. The method of claim 8, said method being further characterized as a method for installing and removing said rod pump from said well, said removing method including:

raising said sucker rod string a first distance within said production tubing string with said polished rod sealingly received in said stuffing box thereby unseating said rod pump from said seating means and then raising said dip tube out of engagement with said flapper valve allowing said flapper valve to close and isolate an interior of said production tubing string from said well; and then breaking a seal around said polished rod in said stuffing box; and then further raising said sucker rod string to pull said rod pump from said well.

* * * * *